US011608999B2

(12) United States Patent
Gabusi et al.

(10) Patent No.: US 11,608,999 B2
(45) Date of Patent: Mar. 21, 2023

(54) FAN ASSEMBLY FOR CLEANROOMS

(71) Applicant: I.M.A. INDUSTRIA MACCHINE AUTOMATICHE S.P.A., Ozzano Dell'Emilia (IT)

(72) Inventors: Gabriele Gabusi, Castenaso (IT); Claudio Trebbi, Medicina (IT)

(73) Assignee: I.M.A. INDUSTRIA MACCHINE AUTOMATICHE S.P.A., Ozzano dell'Emilia (IT)

( * ) Notice: Subject to any disclaimer, the term of this patent is extended or adjusted under 35 U.S.C. 154(b) by 1089 days.

(21) Appl. No.: 16/321,428

(22) PCT Filed: Jul. 24, 2017

(86) PCT No.: PCT/EP2017/068652
§ 371 (c)(1),
(2) Date: Jan. 28, 2019

(87) PCT Pub. No.: WO2018/019771
PCT Pub. Date: Feb. 1, 2018

(65) Prior Publication Data

US 2021/0285667 A1 Sep. 16, 2021

(30) Foreign Application Priority Data

Jul. 26, 2016 (IT) ..... 102016000078030

(51) Int. Cl.
*F24F 3/163* (2021.01)
*B08B 15/02* (2006.01)

(52) U.S. Cl.
CPC ..... *F24F 3/163* (2021.01); *F24F 2221/225* (2013.01)

(58) Field of Classification Search
CPC ... F24F 3/163; F24F 2221/225; B08B 15/023; B08B 2215/003
See application file for complete search history.

(56) References Cited

U.S. PATENT DOCUMENTS 4,832,717 A 5/1989 Peters
6,272,767 B1 * 8/2001 Botruff ..... B01L 1/00 34/210

(Continued)

FOREIGN PATENT DOCUMENTS

DE 19619495 A1 11/1997
EP 2014365 A2 1/2009

(Continued)

OTHER PUBLICATIONS

International Search Report and Written Opinion for PCT/EP2017/068652, dated Sep. 27, 2017.

*Primary Examiner* — Kevin Joyner
(74) *Attorney, Agent, or Firm* — Marshall, Gerstein & Borun LLP

(57) ABSTRACT

A fan assembly for cleanrooms includes a chamber defined by a floor, two opposing side walls and an upper wall, an inlet unit for introducing a laminar stream of gas into said chamber directed towards the floor, said chamber being arranged in such a way as to be internally invested by the gas introduced by the inlet unit, where said assembly further includes a conveying channel for the gas and for liquid substances present within the chamber positioned on the floor, said conveying channel is surmounted by a casing defined by an upper wall and by two opposing side walls and each side wall of the casing, being provided with through openings that place the chamber into communication with the conveying channel, said opposing side walls of the casing are arranged spaced apart from the respective opposing side walls of the chamber.

13 Claims, 3 Drawing Sheets

(56) References Cited

U.S. PATENT DOCUMENTS

| | | | | |
|---|---|---|---|---|
| 7,074,123 | B2 * | 7/2006 | Bettridge | H05K 7/20736 312/236 |
| 2003/0222087 | A1 * | 12/2003 | Frickel | B08B 15/023 220/571 |
| 2017/0232434 | A1 * | 8/2017 | Goto | F24F 7/06 422/565 |

FOREIGN PATENT DOCUMENTS

| | | | |
|---|---|---|---|
| JP | S62138637 | A | 6/1987 |
| NL | 7104008 | A | 11/1971 |

* cited by examiner

FAN ASSEMBLY FOR CLEANROOMS

BACKGROUND OF THE INVENTION

Field of the Invention

The object of the invention is a fan assembly for cleanrooms.

Related Technology

It is known that many production processes performed in the pharmaceutical industry must be necessarily implemented in cleanroom areas or in chambers in which the concentration of airborne particles is controlled within predefined limits.

To this end, recourse is made to dispensing, within the chamber itself, of a laminar stream of generally vertical gas, which invests the transport or processing line.

This stream therefore allows removal of the particles from the sterile material being processed; these particles are then intercepted by a suction unit that provides for expulsion of the gas, containing these particles, outside the chamber.

Generally, this one suction unit comprises a suction duct defined on the side wall of the chamber.

U.S. Pat. No. 4,832,717 describes a "clean air cabinet" wherein the air passes through holes obtained on a side wall of the chamber, thus drawing from one side only.

The limitation of arranging the suction duct sideways is that turbulences that prevent an efficient elimination of the particles may occur.

The use of floors provided, on the floor surface, with suction holes connected to a respective suction unit, is also known.

One of the main disadvantages of using this type of flooring is that they require a uniformly distributed suction over the entire flooring to ensure expulsion of the gas, containing these particles, outside the chamber.

Moreover, the holes of the flooring may become blocked due to foreign bodies conveyed by the washing and sanitising fluids used to sanitise the various devices or products being processed.

Neither solution therefore allows the particles to be fully removed, guaranteeing maintenance of the concentration thereof within the predefined limits.

SUMMARY OF THE INVENTION

The main aim of the present invention is to solve the aforementioned problems by proposing a fan assembly for cleanrooms, suitable for allowing efficient expulsion of the gases outside the chamber, thus keeping the concentration of airborne particles within the predefined limits.

In the context of this aim, one object of the invention is to propose a fan assembly for cleanrooms that prevents microturbulences from being created in the stream of air circulating within the chamber, thus allowing an efficient elimination of the particles.

Another object of the present invention is to provide a fan assembly for cleanrooms that has contained costs, relatively simple practical embodiment and safe application.

This aim and these objects are achieved by a fan assembly for cleanrooms according to claim 1.

BRIEF DESCRIPTION OF THE DRAWINGS

Further features and advantages of the invention will become apparent from the description of a preferred but non-exclusive embodiment of the fan assembly for cleanrooms, according to the invention, illustrated by way of a non-limiting example in the accompanying drawings, wherein.

DETAILED DESCRIPTION

Figure 1:
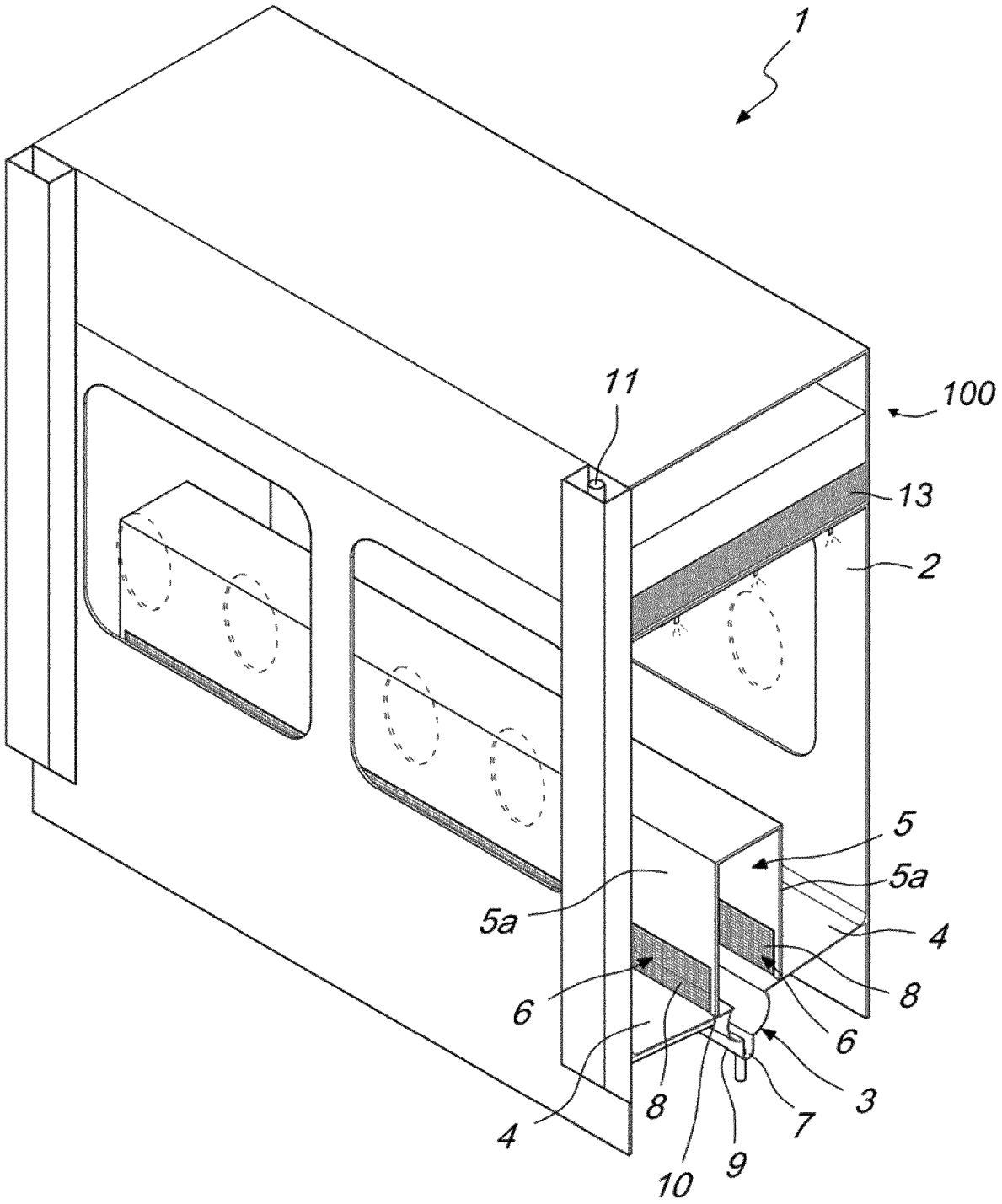
FIG. 1 is an axonometric view of the fan assembly, according to the invention.
Figure 2:
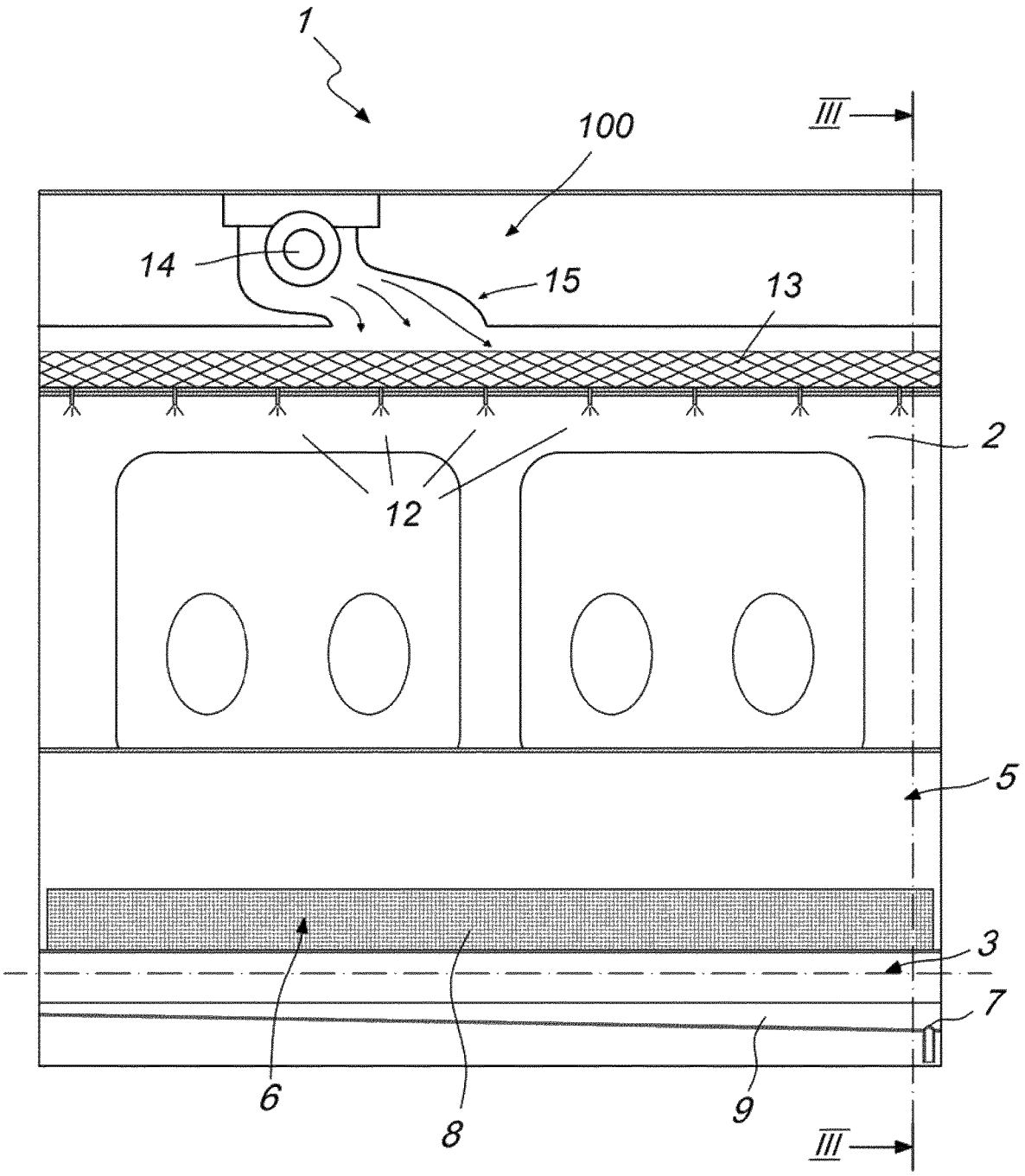
FIG. 2 is a side view of the fan assembly, according to the invention.
Figure 3:
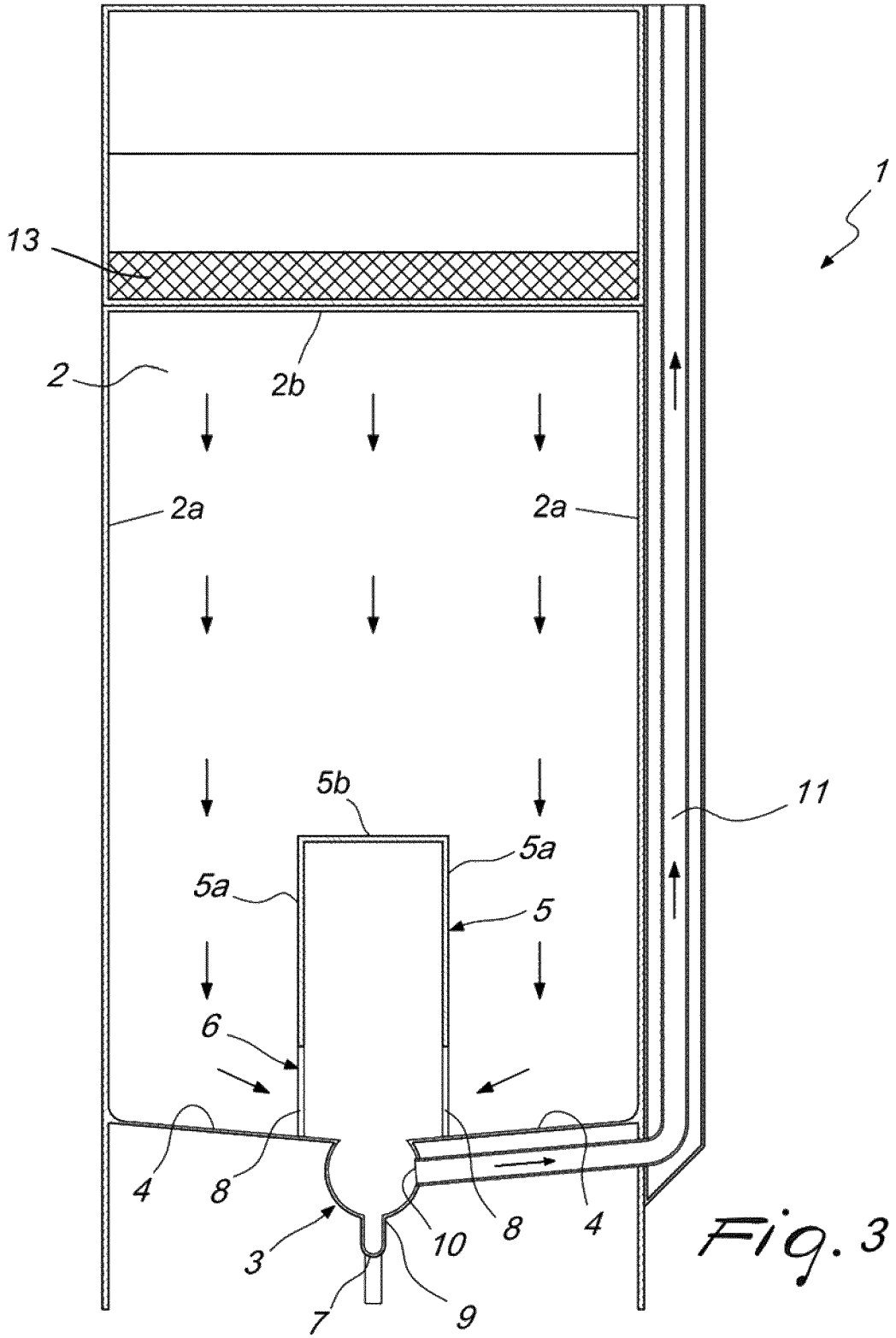
FIG. 3 is a cross-section of FIG. 2 taken along the plane III-III.

With particular reference to these figures, a fan assembly for cleanrooms 2 is globally indicated by 1.

The production processes performed in the pharmaceutical industry must in fact be necessarily implemented in cleanroom areas or in chambers in which the concentration of airborne particles is controlled within predefined limits.

For this purpose, assembly 1 comprises an inlet unit 100, arranged in the upper wall 2*b* of the chamber 2, of a laminar stream of gas directed towards a transport line, and suction members (not shown in the drawings) of the air for extracting the gas from chamber 2.

The chamber 2 is defined by a floor 4, two opposing side walls 2*a* and by an upper wall 2*b*.

According to the invention, the assembly 1 comprises at least one conveying channel 3 for the gas and for liquid substances present in the chamber 2 defined, preferably in a substantially central position, on the floor 4 of the chamber 2 at the transport line.

This channel 3 is surmounted by a casing 5. This casing 5 is defined by an upper wall 5*b* and by two opposing side walls 5*a*. Each side wall 5*a* of the casing 5 is provided with through holes 6 which place the chamber 2 into communication with the conveying channel 3. The opposing side walls 5*a* of the casing 5 are arranged spaced apart from the respective opposing side walls 2*a* of the chamber 2.

This channel 3 is also connected to the suction members of the chamber 2.

The gas, dispensed by the inlet unit, then passes through the openings 6. This gas is extracted by means of the suction members.

This arrangement is extremely advantageous as it ensures that the laminar stream of gas can circulate inside the chamber 2 without microturbulences being created, thereby allowing expulsion from the chamber 2 of the particles and/or contaminants in suspension in the air that could accumulate inside the chamber 2 and the components contained therein.

According to one especially practical and useful solution, the conveyance channel 3 can be provided with a discharge outlet 7 for the liquid substances present inside the chamber 2.

It is indeed possible for the chamber 2 and the components contained therein, to be subjected to cleaning and sanitising operations in order to completely remove the dust and residue.

The washing and sanitising fluids will then be conveyed towards the channel 3 to be in turn expelled outside of the chamber 2 through the outlet 7.

By way of example, the washing and sanitising fluids can be preferably selected from water, water vapour, hydrogen peroxide, hydrogen peroxide vapour, solvents, solvent vapour, gas mixtures containing ozone, liquid mixtures, gas mixtures and the like.

In order to further promote the outflow of the liquid substances through the openings 6 in the conveying channel 3, the floor 4 can incline from each side wall 2*a* of the chamber 2 towards the conveying channel 3.

Moreover, said casing 5 may comprise, at the openings 6, at least one grille 8 suitable for allowing the passage of the gas and for preventing the passage of foreign bodies.

It should also be specified that the channel 3 can comprise a lower longitudinal discharge duct 9 for collecting the liquid substances; the discharge outlet 7 can then be placed in the lower portion of this longitudinal discharge duct 9.

Moreover, the possibility of the conveyance channel 3 comprising a passage 10 for a respective connecting duct 11 to the suction members, is not excluded.

This passage 10 may be defined on a side wall of the channel 3.

The presence of the discharge duct 9 therefore allows the liquid substances to be conveyed at a lower height with respect to that of passage 10, thus the possibility of the liquid substances being expelled through the air suction unit is further prevented.

Indeed, the liquid substances will tend, due to gravity, to accumulate on the bottom of the conveying duct 3 and, in particular, in the longitudinal discharge duct 9.

There is also provided the possibility of said duct 11 having a first portion arranged below the flooring 4 of the chamber 2 and a second portion along the side wall 2*a* of the chamber 2 itself.

In order to further promote the outflow of the liquid substances through the discharge outlet 7, the longitudinal discharge duct 9 may have a slope towards the outlet 7.

It should be noted that the inlet unit 100 of a laminar stream of gas comprises a fan compressor 14, a pipe 15 connected downstream of the compressor 14, and a plurality of dispensing nozzles 12 surmounting the conveyance line. The nozzles are arranged on the upper wall 2*b* of the chamber 2.

In this way, it will thus be possible to generate a downward stream of laminar gas that will flow along the entire transport line and the respective products present thereon.

It is specified that, preferably, the gas introduced by the inlet apparatus will be air, preventively filtered through a suitable filter 13. The filter 13 is interposed between the inlet unit 100 and the chamber 2 to filter the gas introduced by the inlet unit 100 before it reaches the chamber 2. The use of other types of gas, such as for example inert gases, nitrogen and the like according to the specific application needs, is not excluded.

Advantageously, the present invention solves the aforementioned problems, by proposing a fan assembly 1 for cleanrooms 2, suitable for allowing expulsion of the gases outside the chamber 2, thus keeping the concentration of airborne particles within the predefined limits.

Opportunely, the fan assembly 1 for cleanrooms 2 prevents microturbulences from being created in the stream of air that circulates inside the chamber 2 allowing an efficient elimination of the particles.

The invention thus devised is susceptible to a number of modifications and variants, all of which fall under the inventive concept; moreover, all the details can be replaced by other technically equivalent elements.

In the embodiments illustrated, individual features, reported in relation to specific embodiments, may in actual fact be interchanged with other different features that exist in other embodiments.

In practice, any materials and any sizes may be used according to requirements and the state of the art.

The invention claimed is:

1. A fan assembly for clean rooms comprising: a chamber defined by a floor, two opposing side walls and an upper wall, an inlet unit positioned on the upper wall of said chamber for introducing a laminar stream of gas into said chamber directed towards the floor, said chamber being arranged in such a way as to be internally invested by the gas introduced by the inlet unit, wherein said assembly further comprises a conveying channel extending longitudinally along the entire chamber and being positioned on the floor, said conveying channel is enclosed by a casing defined by an upper wall and by two opposing side walls extending vertically from the floor up to the upper wall of the casing, and wherein each side wall of the casing faces a corresponding side wall of the chamber and is provided with a plurality of through openings spaced along a length of the casing to place the chamber into communication with the conveying channel through the plurality of through openings, and wherein each of said opposing side walls of the casing is arranged to be spaced apart from a corresponding one of the opposing side walls of the chamber.

2. The fan assembly according to claim 1, wherein said opposing side walls of the casing are parallel to each other.

3. The fan assembly according to claim 1, wherein said casing is arranged in a central position on the floor of said chamber.

4. The fan assembly according to claim 1, wherein said conveying channel is provided with a discharge outlet for liquid substances present within said chamber.

5. The fan assembly according to claim 4, wherein said channel comprises a longitudinal discharge duct for collecting said liquid substances.

6. The fan assembly according to claim 5, wherein said discharge outlet is positioned in the lower portion of said longitudinal discharge duct.

7. The fan assembly according to claim 5, wherein said longitudinal discharge duct has a slope towards said outlet in order to facilitate the outflow of said liquid substances through said outlet.

8. The fan assembly according to claim 1, wherein said floor inclines from each side wall of the chamber towards the conveying channel.

9. The fan assembly according to claim 1, further comprising air suction members for extracting said gas from the casing.

10. The fan assembly according to claim 9, wherein said conveying channel comprises a passage for a connecting duct to said suction members, said passage being positioned on a side wall of said channel.

11. The fan assembly according to claim 1, wherein said casing comprises, at said openings, at least one grille suitable for allowing the passage of the gas and for preventing the passage of foreign bodies.

12. The fan assembly according to claim 1, wherein said inlet unit of a laminar stream of gas, comprises a fan compressor, a pipe connected downstream of said compressor, and a plurality of dispensing nozzles positioned on the upper wall of the chamber.

13. The fan assembly, according to claim 1, comprising a filter interposed between the inlet unit and the chamber for filtering the gas introduced by the inlet unit.

* * * * *